US011350761B2

(12) United States Patent
Mellors

(10) Patent No.: US 11,350,761 B2
(45) Date of Patent: Jun. 7, 2022

(54) INFLATABLE INSULATED VACUUM PANEL

(71) Applicant: Blue Planet Buildings Ltd, Nottingham (GB)

(72) Inventor: Edward James Mellors, Nottingham (GB)

(73) Assignee: Blue Planet Buildings Ltd

( * ) Notice: Subject to any disclaimer, the term of this patent is extended or adjusted under 35 U.S.C. 154(b) by 52 days.

(21) Appl. No.: 16/642,922

(22) PCT Filed: Sep. 10, 2018

(86) PCT No.: PCT/GB2018/052570

§ 371 (c)(1),
(2) Date: Feb. 28, 2020

(87) PCT Pub. No.: WO2019/048890

PCT Pub. Date: Mar. 14, 2019

(65) Prior Publication Data

US 2020/0345150 A1 Nov. 5, 2020

(30) Foreign Application Priority Data

Sep. 8, 2017 (GB) ..... 1714524

(51) Int. Cl.
*A47C 27/08* (2006.01)
*E04B 1/80* (2006.01)
(Continued)

(52) U.S. Cl.
CPC ..... *A47C 27/081* (2013.01); *E04B 1/803* (2013.01); *A47G 2009/003* (2013.01);
(Continued)

(58) Field of Classification Search
CPC ..... A47C 27/081; E04B 1/803; E04B 1/806; A47G 2009/003; E04H 15/20; E04H 2015/202; E04H 2015/208
See application file for complete search history.

(56) References Cited

U.S. PATENT DOCUMENTS 5,270,092 A * 12/1993 Griffith ..... B32B 3/12 428/69
5,508,126 A 4/1996 Braun
(Continued)

FOREIGN PATENT DOCUMENTS

EP 0675992 10/1995
GB 1519581 8/1978
(Continued)

OTHER PUBLICATIONS

Translation of WO 94/13909 (Year: 1994).*
International Search Report issued in International Application No. PCT/GB2018/052570, four pages.

*Primary Examiner* — Michael Safavi
(74) *Attorney, Agent, or Firm* — Merek, Blackmon & Voorhees, LLC

(57) ABSTRACT

The present invention provides an inflatable panel (10) comprising an inflatable first part (12) having an internal compartment (13); an inflatable second part (14) having an internal compartment (15); and a third part (16) connecting the first part (12) to the second part (14) at a periphery of the first and second parts (12, 14). The first, second, and third parts (12, 14, 16) together define a sealed enclosure (18) therebetween. The inflatable panel (10) also includes means for evacuating air from the sealed enclosure (18), and said sealed enclosure is configured to increase thermal insulation between the first part (12) and the second part (14).

18 Claims, 3 Drawing Sheets

(51) Int. Cl.
*E04H 15/20* (2006.01)
*A47G 9/00* (2006.01)

(52) U.S. Cl.
CPC ..... *E04H 15/20* (2013.01); *E04H 2015/202* (2013.01); *E04H 2015/208* (2013.01)

(56) References Cited

U.S. PATENT DOCUMENTS

| | | | | | |
|---|---|---|---|---|---|
| 5,599,636 | A | | 2/1997 | Braun | |
| 5,966,763 | A | * | 10/1999 | Thomas | A47C 27/086 5/715 |
| 7,968,160 | B2 | * | 6/2011 | Yeganeh | E04B 1/803 428/34.1 |
| 2009/0081395 | A1 | | 3/2009 | Yeganeh | |
| 2015/0176266 | A1 | | 6/2015 | Duforestel et al. | |

FOREIGN PATENT DOCUMENTS

| | | |
|---|---|---|
| WO | WO 85/04211 | 9/1985 |
| WO | WO 94/13909 | 6/1994 |
| WO | WO 2016/145239 | 9/2016 |

* cited by examiner

INFLATABLE INSULATED VACUUM PANEL

FIELD OF THE INVENTION

The present invention relates to an inflatable insulated panel, in particular an inflatable insulated vacuum panel.

BACKGROUND OF THE INVENTION

Inflatable panels are employed for a number of applications such as for the construction of inflatable tents, as an underlay for a sleeping bag or tent, or as part of an inflatable mattress or bed.

An advantage of inflatable panels when used as a shelter, part of a shelter and/or item of furniture is that they can be easily inflated for deployment and rolled up when not in use for minimal transportation benefits. However, due to the nature of the construction of the panels, they are not thermally efficient and in hot or cold weather do not provide sufficient insulation, often requiring significant energy in the form of heating or cooling to maintain a habitable environment.

There is therefore a need for an inflatable panel which is both thermally efficient and provides adequate insulation from the heat or cold when used as part of a shelter or item of furniture.

SUMMARY OF THE INVENTION

According to a first aspect there of the present invention, there is provided an inflatable panel comprising:

an inflatable first part having an internal compartment;

an inflatable second part having an internal compartment; and a third part connecting the first part to the second part at a periphery of the first and second parts, the first, second, and third parts together defining a sealed enclosure therebetween; and means for evacuating air from the sealed enclosure, wherein, said sealed enclosure is configured to increase thermal insulation between the first part and the second part.

An inflatable insulated panel in accordance with the invention provides a thermally efficient, rigid, external structure that can be inflated for deployment and rolled up when not in use for minimal transportation benefits.

Preferably, the third part is inflatable and includes an internal compartment.

Preferably, the first, second and/or third parts comprise a flexible material.

Preferably, the first, second and/or third parts comprise a waterproof material.

Preferably, the first and/or second part comprises a drop-stitch structure.

In exemplary embodiments wherein the third part is inflatable, the third part may comprise a drop-stitch structure.

By having a drop-stitch structure, the first part, second part or third part will provide an inflatable structure that when inflated is very stable, uniform in shape when pressurised and is capable of withstanding significant loads without losing its prime shape.

In exemplary embodiments wherein the third part is not inflatable, the third part may comprise a drop-stitch structure.

The first, second and third parts are made from any suitable material. Preferably the first, second and third parts each comprise a plastics or rubber material.

The plastics material may be in the form of a PVC or textile-reinforced urethane plastic material.

The rubber material may be in the form of a synthetic rubber for example Hypalon®.

In exemplary embodiments, the first, second and/or third part is constructed from a fabric having a flexible and waterproof coating. Preferably the fabric is polyester and the coating is a PVC or synthetic rubber coating.

Such a construction provides added rigidity to the first, second and/or third panel while also increasing its resistance to stretching, tearing and/or tension.

In exemplary embodiments, the inflatable panel further comprises a plurality of hollow pillar-like structures in fluid communication with the internal compartment of the first part; said plurality of hollow pillar-like structures extending from an internal surface of the first part into the sealed enclosure.

In exemplary embodiments, the inflatable panel further comprises a plurality of hollow pillar-like structures in fluid communication with the internal compartment of the second part; said plurality of hollow pillar-like structures extending from an internal surface of the second part into the sealed enclosure.

In exemplary embodiments the inflatable panel further comprises a plurality of hollow pillar-like structures extending from both an internal surface of the first part into the sealed enclosure and an internal surface of the second part into the sealed enclosure, the pillar-like structures being in fluid communication with the adjacent first part or second part. The pillar-like structures extending from the internal surface of the first part may be aligned with the pillar-like structures extending from the second part.

In configurations incorporating a plurality of hollow pillar-like structures, preferably, a rigid insulator is at least partially housed in at least one hollow pillar-like structure. The rigid insulator is made from a material having a very low thermal conductivity.

Preferably, each pillar-like structure at least partially houses a rigid insulator.

In configurations not incorporating a plurality of hollow pillar-like structures, preferably the inflatable panel further comprises a plurality of rigid insulators positioned between inflatable first part and the inflatable second part, each rigid insulator comprising a first end connected to a surface of the first part and a second end connected to a surface of the second part.

Preferably, the inflatable panel further comprises means for introducing fluid into the first part and/or second part.

The means for introducing fluid into the first part and/or second part may be any suitable means known in the art, for example may be in the form of an inlet valve or an integrated fluid pump. The fluid pump may be an air pump or pressure pump.

Preferably, the first part and/or the second part are in fluid communication with each other.

In exemplary configurations, wherein the third part is inflatable, the first part, second part and third part may all be in fluid communication with each other. Having the first, second and third parts in fluid communication with each other allows all the inflatable parts of the inflatable panel to be inflated via a single point or means.

Preferably, the first part and/or second part and/or third part is inflatable to a pressure above atmospheric pressure.

The means for evacuating air from the sealed enclosure may be any suitable means known in the art. For example, the means for evacuating air from the sealed enclosure may comprise a vacuum release valve or integrated vacuum pump.

In accordance with a second aspect of the present invention, there is provided an inflatable panel comprising:

an inflatable first part having an internal compartment;

an inflatable second part having an internal compartment; and a third part connecting the first part to the second part at a periphery of the first and second parts, the first, second, and third parts together defining a sealed enclosure therebetween;

said sealed enclosure comprising a filling in the form of a thermal insulator;

wherein, said sealed enclosure is configured to increase thermal insulation between the first part and the second part.

Preferably, the third part is inflatable and includes an internal compartment.

Preferably, the first and/or second part comprises a drop-stitch structure.

Preferably, the third part comprises a drop-stitch structure.

Preferably, the panel further comprises means for introducing fluid into the first part and/or second part.

Preferably, the first part and the second part are in fluid communication with each other.

Preferably, the first part, second part and third part are all in fluid communication with each other.

Preferably, the first part and/or second part is inflatable to a pressure above atmospheric pressure.

Preferably, the third part is inflatable to a pressure above atmospheric pressure.

The filling may be the form of any suitable thermal insulator. For example, the filling may be a wool insulation filling; glass mineral wool insulation filling, foam insulation filling, or aerogel insulation filling.

In accordance with a third aspect of the present invention, there is provided an inflatable panel assembly comprising two or more inflatable panels connected together, each of the two or more inflatable panels comprising:

an inflatable first part having an internal compartment;

an inflatable second part having an internal compartment; and a third part connecting the first part to the second part at a periphery of the first and second parts, the first, second, and third parts together defining an enclosure therebetween;

the first part, second part and third part being in fluid communication with each other and being sealed from said enclosure therebetween;

wherein the first part of first inflatable panel of said two or more panels is in fluid communication with the first part of an adjacent inflatable panel connected thereto, and the enclosure of said first inflatable panel is in fluid communication with the enclosure of said adjacent inflatable panel;

and wherein the inflatable panel assembly includes means for evacuating air from the enclosure of the first inflatable panel, and the enclosure of each of said two or more inflatable panels is configured to increase thermal insulation between the first part and the second part of a respective inflatable panel.

The panels forming the panel assembly of the second aspect may include one or more features of an inflatable panel in accordance with the first aspect.

In accordance with a fourth aspect, there is provided an inflatable panel assembly comprising two or more inflatable panels connected together, each of the two or more inflatable panels comprising:

an inflatable first part having an internal compartment;

an inflatable second part having an internal compartment; and a third part connecting the first part to the second part at a periphery of the first and second parts, the first, second, and third parts together defining an enclosure therebetween;

the first part and second part being in fluid communication with each other and being sealed from said enclosure therebetween;

wherein the first part of first inflatable panel of said two or more panels is in fluid communication with the first part of an adjacent inflatable panel connected thereto; and wherein the inflatable panel assembly includes a filling in the form of a thermal insulator positioned in the enclosure of each of said two or more inflatable panels, and the enclosure of each of said two or more inflatable panels is configured to increase thermal insulation between the first part and the second part of a respective inflatable panel According to a fifth aspect of the present invention, there is provided a floor comprising an inflatable panel in accordance with the first aspect or second aspect, or an inflatable panel assembly in accordance with the third or fourth aspect.

According to a sixth aspect of the present invention, there is provided a ground sheet comprising an inflatable panel in accordance with the first aspect or second aspect; or an inflatable panel assembly in accordance with the third or fourth aspect.

According to a seventh aspect of the present invention, there is provided a wall comprising an inflatable panel in accordance the first aspect or second aspect, or an inflatable panel assembly in accordance with the third or fourth aspect.

According to a eighth aspect of the present invention, there is provided an inflatable shelter comprising an inflatable panel in accordance with the first aspect or second aspect, or an inflatable panel assembly in accordance with the third or fourth aspect.

Other aspects are as set out in the claims herein.

BRIEF DESCRIPTION OF THE DRAWING

For a better understanding of the invention and to show how the same may be carried into effect, there will now be described by way of example only, specific embodiments, methods and processes according to the present invention with reference to the accompanying drawings in which.

DETAILS DESCRIPTION OF THE EMBODIMENTS

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Figure 1:
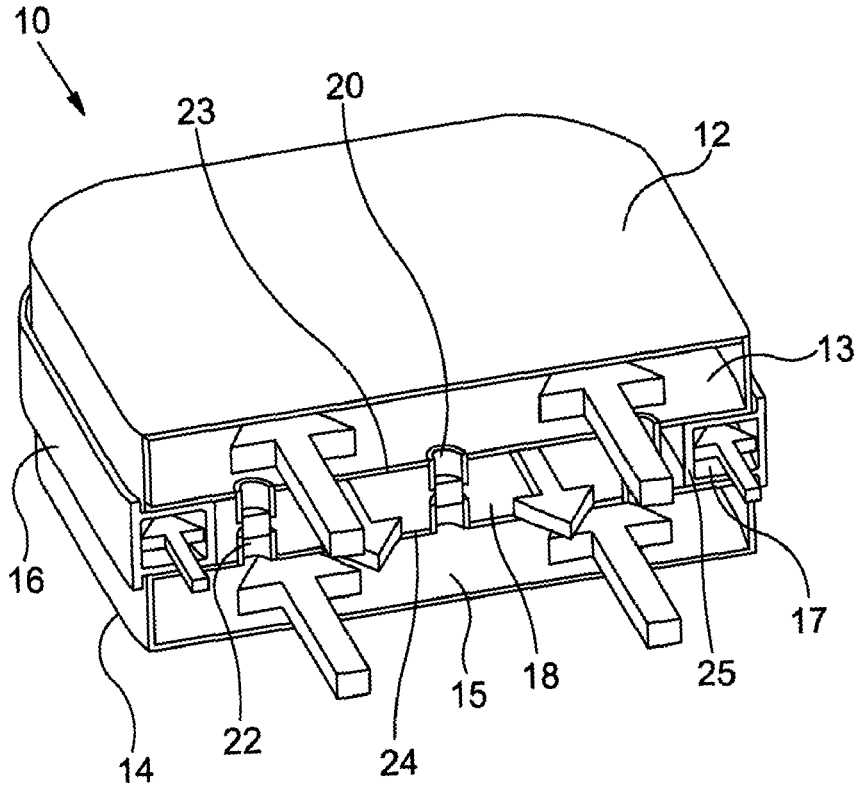
FIG. 1 is a schematic representation of a first embodiment of an inflatable panel in accordance with the invention.

With reference to FIG. 1, a first embodiment of an inflatable vacuum panel 10 (herein after referred to as a "panel") in accordance with a first aspect of the invention is shown.

The panel 10 comprises a first part 12 having an internal compartment 13, a second part 14 having an internal compartment 15, and a third part 16 having an internal compartment 17.

The first, second and third parts 12, 14, 16 are each inflatable and the third part 16 is sandwiched between the first part 12 and the second part 14. The third part 16 connects the first part 12 to the second part 14 at a periphery of the first and second parts 12, 14.

The first, second and third parts 12, 14, 16 are made from a plastics or rubber material, for example from PVC or from a textile-reinforced urethane plastic or a fabric with a PVC or synthetic rubber coating.

The panel 10 further comprises a sealed enclosure 18 positioned between the first part 12, second part 14 and third part 16. The first, second and third parts 12, 14, 16 together define the sealed enclosure, that is to say an inner wall 23, 24, 25 of each of the first part 12, second part 14, and third part 16 substantially defines the perimeter of the sealed enclosure 18 and that the sealed enclosure is sealed from the first part 12, second part 14, and third part 16.

Means for evacuating air from the sealed enclosure 18 (not shown) and means for introducing fluid into the first part 12, second part 14 and third part 16 (not shown) are incorporated into the panel 10. The means for evacuating air from the sealed enclosure 18 may be in the form of a vacuum release valve or a vacuum pump integrated with or temporarily attached to the panel 10.

When air from the sealed enclosure 18 is evacuated, a vacuum chamber in the panel 10 is created via the evacuated sealed enclosure 18. The vacuum chamber facilitates an increase in thermal insulation between the first part 12 and the second part 14.

The means for evacuating air from the sealed enclosure 18 can be used to create a partial vacuum or a full vacuum within the vacuum chamber.

The first part 12, second part 14 and third part 16 are each formed from a drop-stitch structure, for example a constructed of a drop-stitch inflatable member.

Drop-stitch is a widely known technique incorporating fibres that tie the external faces of the form together. This creates inflatable structures with very stable, uniform shapes when pressurised and are capable of withstanding significant loads without losing their prime shape.

The incorporation of a drop-stitch structure allows the first, second and third parts 12, 14, 16 to acts as rigid layers once inflated, preserving the integrity of the sealed enclosure 18 when a negative (near absolute zero) pressure is generated in the sealed enclosure 18.

The third part 16 provides lateral stability to the panel 10 and prevents edge collapse of the vacuum chamber formed by the sealed enclosure 18.

In the embodiment shown, the first part 12, second part 14, and third part 16 are all in fluid communication with each other. This allows the parts of the panel 10 to be inflated by a single means from a single point. It would be understood that it is possible for fluid communication between the parts of the panel to be restricted such that each part would need to be separately inflated.

The first part 12, second part 14 and third part 16 are each configured to be inflatable to a pressure above atmospheric pressure.

The inside of the panel 10 includes a plurality of hollow pillar-like structures 20, 22. The plurality of pillar-like structures 20, 22 extend from both an internal surface of the first part 12 into the sealed enclosure 18 and an internal surface of the second part 16 into the sealed enclosure 18. The inner surface of the first part and the inner surface of the second part corresponds to the respective inner wall 23, 24 of the first and second parts 12, 14 which define the sealed enclosure 18. The pillar-like structures 20, 22 are in fluid communication with the adjacent first part 12 or second part 14.

In the embodiment shown, the pillar-like structures 20 extending from the internal surface 23 of the first part 12 are aligned with the pillar-like structures 22 extending from the second part 14. It would be understood that the pillar-like structures 20, 22 may not be aligned with one another.

Rigid insulators 21 are partially housed in opposing aligned pillar-like structures 20, 22. The rigid insulators 21 are from a material having a very low thermal conductivity. The rigid insulators 21 correspond in shape to the pillar-like structures 20, 22 in which they are partially housed.

The rigid insulators 21 and the pillar-liked structures 20, 22 provide a physical connection between the first part 12 and the second part 14 in order to maintain the stand-off and preserve the vacuum chamber integrity. The rigid insulators 21 prevent a direct fluid connection or direct physical connection between the first part 12 and the second part 14. A direct fluid connection or direct physical connection between the first part 12 and the second part 14 would constitute a thermal bridge between the first part 12 and the second part 14, allowing temperatures of the internal compartments of the first and second parts 12, 14 to match one another at a faster rate than without such a thermal bridge.

Since the mechanical joint between the first part 12 and the second part is thermally broken by the pillar-like structures 20, 22 and the rigid insulators 21, the physical properties required for separation of the parts of the panel 10 whilst maintaining a low thermal conductivity for the panel 10 is achieved.

In use, the first, second and third parts 12, 14, 16 of the panel 10 are inflated to a pressure above atmosphere. The air within the sealed enclosure 18 is then extracted from the sealed enclosure 18 via a vacuum pump (either via a vacuum release valve or integrated with the panel). The extraction of air from the sealed enclosure 18, as mentioned above, creates a vacuum chamber which forms a barrier to thermal transfer between the first and second parts 12, 14.

The pressure in the first and second parts 12, 14 is sufficient to overcome both the tendency of the vacuum chamber 18 to collapse and provide net external pressure to allow the structure of the panel 10 to be self-supporting and withstand loads applied from the outside of the panel 10.

Figure 2:
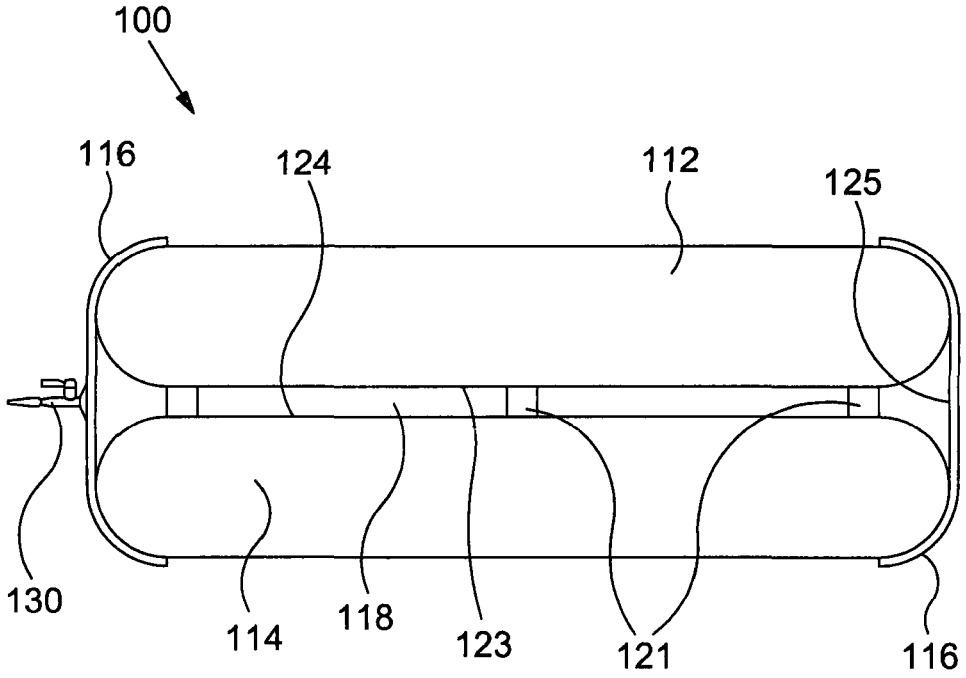
FIG. 2 is a schematic representation of a second embodiment of an inflatable panel in accordance with the invention.

Referring to FIG. 2, a second embodiment of an inflatable vacuum panel 100 (herein after referred to as a "panel") in accordance with a first aspect of the invention is shown.

As in the first embodiment, the panel 100 in accordance with the second embodiment comprises a first part 112 having an internal compartment and a second part 114 having an internal compartment.

The panel also includes a third part 116, however, unlike in the first embodiment, the third part 116 does not comprise an internal compartment.

The first and second parts 112, 114 are each inflatable in a similar manner to the first and second parts of the first embodiment. The first and second parts are arranged parallel to one another and the third part is configured to provide a boundary around the periphery of the first and second parts 112, 114.

The first, second and third parts 112, 114, 116 are made from a plastics or rubber material, for example from PVC or from a textile-reinforced urethane plastic or a fabric with a PVC or synthetic rubber coating.

As in the previously described embodiment, the panel 100 further comprises a sealed enclosure 118 positioned between the first part 12, the second part 114 and the third part 116. The first, second and third parts 112, 114, 116 together define the sealed enclosure, that is to say an inner wall 123, 124, 125 of each of the first part 112, second part 114, and third part 116 substantially defines the perimeter of the sealed enclosure 118, and that the sealed enclosure is sealed from the first part 112, second part 114, and third part 116.

Means for evacuating air from the sealed enclosure 130 and means for introducing fluid into the first part 12 and second part 14 (not shown) are incorporated into the panel 100. In the embodiment shown, the means for evacuating air from the sealed enclosure 118 is in the form of a vacuum release valve, however it would be understood that it may be in a different form for example the mean for evacuating air from the sealed enclosure 118 may be in the form of a vacuum pump.

When air from the sealed enclosure 118 is evacuated, a vacuum chamber in the panel 100 is created via the evacuated sealed enclosure 118. The vacuum chamber facilitates an increase in thermal insulation between the first part 112 and the second part 114. Like in the first embodiment, the first part 112 and second part 114 are each formed from a drop-stitch structure, and the first part 112 and second part 114 are in fluid communication with each other to facilitate inflation of the parts by a single means from a single point. It would be understood that fluid communication between the parts of the panel 100 may be restricted such that each part would need to be separately inflated.

The first part 112 and second part 114 are each configured to be inflatable to a pressure above atmospheric pressure.

In the embodiment shown, the third part 116 is formed from a solid membrane structure, however, it would be understood that it may be formed in a different manner, for example a drop-stitch structure etc.

Rigid insulators 121 are positioned between the first part 112 and the second part 114. The rigid insulators 121 are formed of a material having a very low thermal conductivity.

In the embodiment shown, the rigid insulators 121 are substantially cylindrical in shape and act like pillars between the first part 112 and the second part 114. The rigid insulators 121 provide a physical connection between the first part 112 and the second part 114 in order to maintain the stand-off between the two parts and preserve the vacuum chamber integrity. The rigid insulators 121 prevent a direct fluid connection or direct physical connection between the first part 112 and the second part 114.

In certain configurations of inflatable vacuum panels 10, 100 in accordance with the first and second embodiment of the invention, the rigid insulators 21, 121 are arranged in parallel rows. Having the rigid insulators arranged in parallel rows, facilitates the folding or rolling of the inflatable vacuum panel into a compact size for storage and/or transportation.

The number of rows will be determined by the size of the inflatable vacuum panels. It is envisaged that three rows of rigid insulators would be sufficient but more or less rows may be utilized.

In certain configurations, the inflatable vacuum panels 10, 100 further comprise a filling in the form of a thermal insulator within their respective sealed enclosures 18, 118. The thermal insulator filling facilitates the thermal insulation between the first part and the second part of the panels 10, 100. In addition, the thermal insulator filing allows sufficient thermal efficiency to be achieved after only a small amount of air has been evacuated from the sealed enclosure.

The filling is preferably in the form of a compressible filling where the inflatable vacuum panel is intended to be folded or rolled into a compact size for storage and/or transportation, so as not to adversely effect the panel's storage and/or transportation capabilities.

In certain configurations, the inflatable vacuum panels 10, 100 further comprise a reflective layer on the inner surface of the first part and on the inner surface of the second part. The reflective layers will advantageously reflect radiated heat back into or out of the panel.

Figure 3:
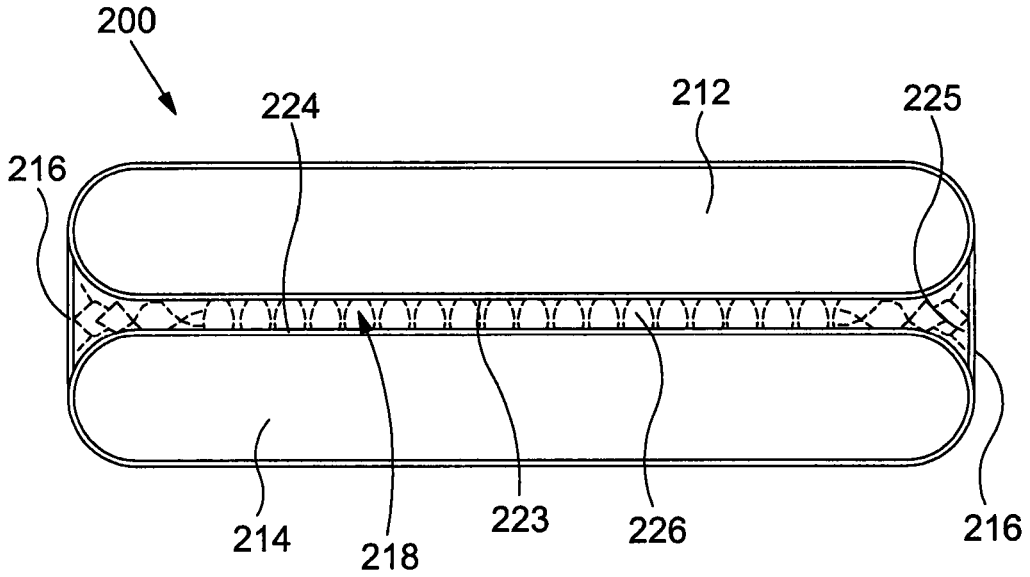
FIG. 3 is a schematic representation of a third embodiment of an inflatable panel in accordance with the invention.

Referring to FIG. 3, a third embodiment of an inflatable panel in accordance with a second aspect is shown.

The panel in accordance with the second aspect, like the above described embodiments, comprises a first part having an internal compartment, a second part having an internal compartment, and a third part. The third part may be of a similar construction to the third part 16 of the first embodiment or the third part 116 of the second embodiment. In the embodiment shown, the first part 212, second part 214, and third part 216 of the panel 200 are of a similar construction to the equivalent parts of the panel 100 of the second embodiment.

As in the previously described embodiments, an inner wall 223, 224, 225 of each of the first part 212, second part 214, and third part 216 substantially defines the perimeter of the sealed enclosure 218

The panel 200 differs from the panels of the first and second embodiment 10, 100 in that air from the sealed enclosure 218 is not arranged to be evacuated therefrom. Instead, the sealed enclosure 218 is filled with a thermal insulator filling 226.

The filling 226 is in the form of a compressible filling and forms a central core of the panel 200.

Apart from the sealed enclosure, all other components of the panel are identical to that of the previously described embodiments (depending on whether of similar construction to the first or second described embodiment) and arranged in a similar fashion as already described so further detail would not be provided.

In accordance with a third aspect of the invention, two or more panels of similar construction to the panels described above in accordance with the first or second embodiments, are tied together to form an inflatable panel assembly. This allows the production of a continuous structure of varied length and/or width.

The first part of each panel of the inflatable panel assembly is in fluid communication with the first part of an adjacent or adjacent panels connected thereto.

Likewise, the enclosure of each panel of the inflatable panel assembly is in fluid communication with the enclosure of an adjacent or adjacent panels.

Having the first parts of each panel in fluid communication with the first part of an adjacent or adjacent panels and the enclosures of each panel in fluid communication with the enclosure of an adjacent or adjacent panels means that only one pressure pump and one vacuum pump is required for any size of structure of the panel assembly.

In accordance with a fourth aspect of the invention, two or more panels of similar construction to the panel described in relation to the second aspect are tied together to form an inflatable panel assembly.

Similar to the assembly of the third aspect, the first part of each panel of the inflatable panel assembly is in fluid communication with the first part of an adjacent or adjacent panels connected thereto and a single pressure pump is provided with the assembly.

The panel or panel assembly in accordance with the invention can be utilized for numerous applications wherever a degree of thermal insulation is required. It can be utilized as part of a floor, a ground sheet, a wall or an inflatable shelter.

When used as a floor, it addresses the combined elements of thermal effectiveness and comfort. The drop-stitch structure of the first part, second part and third part can be inflated to a higher pressure than traditional air mattresses so can provide a walk-able surface.

As a ground sheet for a tent or sleeping bag, it can help mitigate the effects of cold/damp/heat and as well as provide a firm but comfortable surface for sleeping on.

When incorporated as part of an inflatable shelter, an outer surface of the shelter may be provided with a flexible solar film. This is advantageous as it gives a potential for integral power and increased self-sufficiency when the shelter is used in remote operation.

While the panel in accordance with the first embodiment of the first aspect of the invention has been described with pillar-like structures extending from both the first part and second part internal surface, it would be understood that pillar-like structures may extend from only one of the first part or the second part.

The invention claimed is:

1. An inflatable panel comprising:

an inflatable first part having an internal compartment;

an inflatable second part having an internal compartment, wherein the inflatable first part and/or the inflatable second part comprises a drop-stitch structure;

a third part connecting the inflatable first part to the inflatable second part at a periphery of the inflatable first part and the inflatable second part, the inflatable first part, the inflatable second part, and the third part together defining a sealed enclosure therebetween; and means for evacuating air from the sealed enclosure, wherein, said sealed enclosure is configured to increase thermal insulation between the inflatable first part and the inflatable second part.

2. The inflatable panel according to claim 1, wherein the third part is inflatable and includes an internal compartment.

3. The inflatable panel according to claim 1, wherein the third part comprises a drop-stitch structure.

4. The inflatable panel according to claim 1, further comprising a plurality of hollow pillar-like structures in fluid communication with the internal compartment of the inflatable first part; said plurality of hollow pillar-like structures extending from an internal surface of the inflatable first part into the sealed enclosure.

5. The inflatable panel according to claim 1, further comprising a plurality of hollow pillar-like structures in fluid communication with the internal compartment of the inflatable second part; said plurality of hollow pillar-like structures extending from an internal surface of the inflatable second part into the sealed enclosure.

6. The inflatable panel according to claim 4, further comprising a rigid insulator at least partially housed in at least one hollow pillar-like structure.

7. The inflatable panel according to claim 1, further comprising means for introducing fluid into the inflatable first part and/or the inflatable second part.

8. The inflatable panel according to claim 1, wherein the inflatable first part and the inflatable second part are in fluid communication with each other.

9. The inflatable panel according to claim 2, wherein the inflatable first part, the inflatable second part and the third part are all in fluid communication with each other.

10. The inflatable panel according to claim 1, wherein the inflatable first part and/or the inflatable second part is inflatable to a pressure above atmospheric pressure.

11. The inflatable panel according to claim 2, wherein the third part is inflatable to a pressure above atmospheric pressure.

12. The inflatable panel according to claim 1, wherein the means for evacuating air from the sealed enclosure comprises a vacuum release valve.

13. A floor comprising an inflatable panel in accordance with claim 1.

14. A ground sheet comprising an inflatable panel in accordance with claim 1.

15. A wall comprising an inflatable panel in accordance with claim claim 1.

16. An inflatable shelter comprising an inflatable panel in accordance with claim 1.

17. An inflatable panel, comprising:

an inflatable first part having an internal compartment;

an inflatable second part having an internal compartment;

a third part connecting the inflatable first part to the inflatable second part at a periphery of the inflatable first part and the inflatable second part, the inflatable first part, the inflatable second part, and the third part together defining a sealed enclosure therebetween;

means for evacuating air from the sealed enclosure, wherein, said sealed enclosure is configured to increase thermal insulation between the inflatable first part and the inflatable second part; and, a plurality of rigid insulators positioned between the inflatable first part and the inflatable second part, each rigid insulator comprising a first end connected to a surface of the inflatable first part and a second end connected to a surface of the inflatable second part.

18. An inflatable panel assembly comprising two or more inflatable panels connected together, each of the two or more inflatable panels comprising:

an inflatable first part having an internal compartment;

an inflatable second part having an internal compartment, wherein the inflatable first part and/or the inflatable second part comprises a drop-stitch structure; and a third part connecting the inflatable first part to the inflatable second part at a periphery of the inflatable first part and the inflatable second part, the inflatable first part, the inflatable second part, and the third part together defining an enclosure therebetween;

the inflatable first part and the inflatable second part being in fluid communication with each other and being sealed from said enclosure therebetween;

wherein the inflatable first part of a first inflatable panel of said two or more panels is in fluid communication with the inflatable first part of an adjacent inflatable panel connected thereto, and the enclosure of said first inflatable panel is in fluid communication with the enclosure of said adjacent inflatable panel;

and wherein the inflatable panel assembly includes means for evacuating air from the enclosure of the first inflatable panel, and the enclosure of each of said two or more inflatable panels is configured to increase thermal insulation between the inflatable first part and the inflatable second part of a respective inflatable panel.

* * * * *